US007424839B2

(12) United States Patent
Chiang

(10) Patent No.: US 7,424,839 B2
(45) Date of Patent: Sep. 16, 2008

(54) WRENCH

(76) Inventor: Mu-Pei Chiang, No. 24, Lane 128, Sec. 1, Chung-Ching Rd., Shy-Te Village, Ta-Ya Hsiang, Taichung Hsien (TW)

( * ) Notice: Subject to any disclaimer, the term of this patent is extended or adjusted under 35 U.S.C. 154(b) by 0 days.

(21) Appl. No.: 11/496,607

(22) Filed: Jul. 31, 2006

(65) Prior Publication Data

US 2008/0022814 A1 Jan. 31, 2008

(51) Int. Cl.
*B25B 13/06* (2006.01)

(52) U.S. Cl. ..... 81/177.8; 81/177.2; 81/177.6; 81/177.7

(58) Field of Classification Search ..... 81/35, 81/177.75, 177.8, 177.85, 177.9, 415–423, 81/177.1; D8/21–29; 140/119
See application file for complete search history.

(56) References Cited

U.S. PATENT DOCUMENTS 1,320,137 A * 10/1919 Gunn ..... 81/62
4,901,608 A * 2/1990 Shieh ..... 81/177.8
5,279,189 A * 1/1994 Marino ..... 81/177.8
5,913,495 A * 6/1999 Maciel Thom et al. ..... 248/52
6,899,002 B2 * 5/2005 Willis, Sr. ..... 81/177.7
7,000,507 B1 * 2/2006 Lin ..... 81/177.9

* cited by examiner

*Primary Examiner*—Joseph J. Hail, III
*Assistant Examiner*—Anthony Ojini
(74) *Attorney, Agent, or Firm*—Alan Kamrath; Kamrath & Associates PA

(57) ABSTRACT

A wrench has a body, a head and at least one pivotal device. The body has two arms separately formed on a distal end of the body and a mounting recess formed between the two arms. Each arm has a hole defined through the arm. The head is rotatably and replaceably mounted inside the mounting recess and has a driving hole defined through the head and two pivotal holes defined in the outer surface of the head and facing the holes in the body. The at least one pivotal device is movably mounted between the body and the head for holding the head. When the wrench is in use, the body may be rotated at various angles relative to the head, so that the wrench could be used in a limited space and is convenient in use. Furthermore, the head may be conveniently replaced depending on a user's needs.

14 Claims, 15 Drawing Sheets

WRENCH

BACKGROUND OF THE INVENTION

1. Field of the Invention

The present invention relates to a wrench and, more particularly, to a wrench that can be operated in a limited space and that is convenient in use.

2. Description of Related Art

With reference to FIG. 13, a first conventional wrench has a body (50) and a head (51). The head (51) is pivotally mounted on the body (50) and has a ratchet hole (52) defined in the head (51). When the wrench is in use, the ratchet hole (52) is mounted around a nut (40), and the body (50) is rotated. Because the head (51) of wrench is pivotally mounted on the body (50), the wrench could be used in a limited space. However, when the angle formed between the head (51) and the body (50) is near a right angle, rotating the wrench is difficult. Furthermore, when the user wants to rotate nuts in different sizes, replacing a different head (51) is necessary.

With reference to FIGS. 14 and 15, a second conventional wrench has a body (60), two heads (61), two pins (62) and two springs (63). The body (60) has a distal end, a proximal end and two through holes (600). The two through holes (600) are respectively defined through the distal end and the proximal end. The two heads (61) are mounted on the distal end and the proximal end of the body (60). The two springs (63) are respectively mounted inside the through holes (600). The two pins (62) are respectively mounted through the heads (61) and the through holes (600) in the body (60). When such wrench is in use, the heads (61) of the wrench could be rotated in a limited space. However, when the angle between the head (61) and the body (60) is near a right angle, rotating the wrench is difficult.

To overcome the shortcomings, the present invention provides a wrench to mitigate the aforementioned problems.

SUMMARY OF THE INVENTION

The primary objective of the present invention is to provide a wrench that can be used in a limited space and that is convenient in use.

A wrench has a body, a head and at least one pivotal device. The body has two arms separately formed on a distal end of the body and a mounting recess formed between the two arms. Each arm has a hole defined through the arm. The head is rotatably and replaceably mounted inside the mounting recess and has a driving hole defined through the head and two pivotal holes defined in the outer surface of the head and facing the holes in the body. The at least one pivotal device is movably mounted between the body and the head for holding the head.

When the wrench is in use, the body may be rotated at various angles relative to the head, so that the wrench could be used in a limited space and is convenient in use. Furthermore, the head may be conveniently replaced depending on a user's needs.

Other objectives, advantages and novel features of the invention will become more apparent from the following detailed description when taken in conjunction with the accompanying drawings.

DETAILED DESCRIPTION OF THE PREFERRED EMBODIMENT

To solve the shortcomings of the conventional wrench, the present invention provides a wrench that can be used in a limited space and is convenient in use. The wrench of the present invention has a body, a head pivotally mounted on the body and at least one pivotal device connected between the body and the head.

Figure 1:
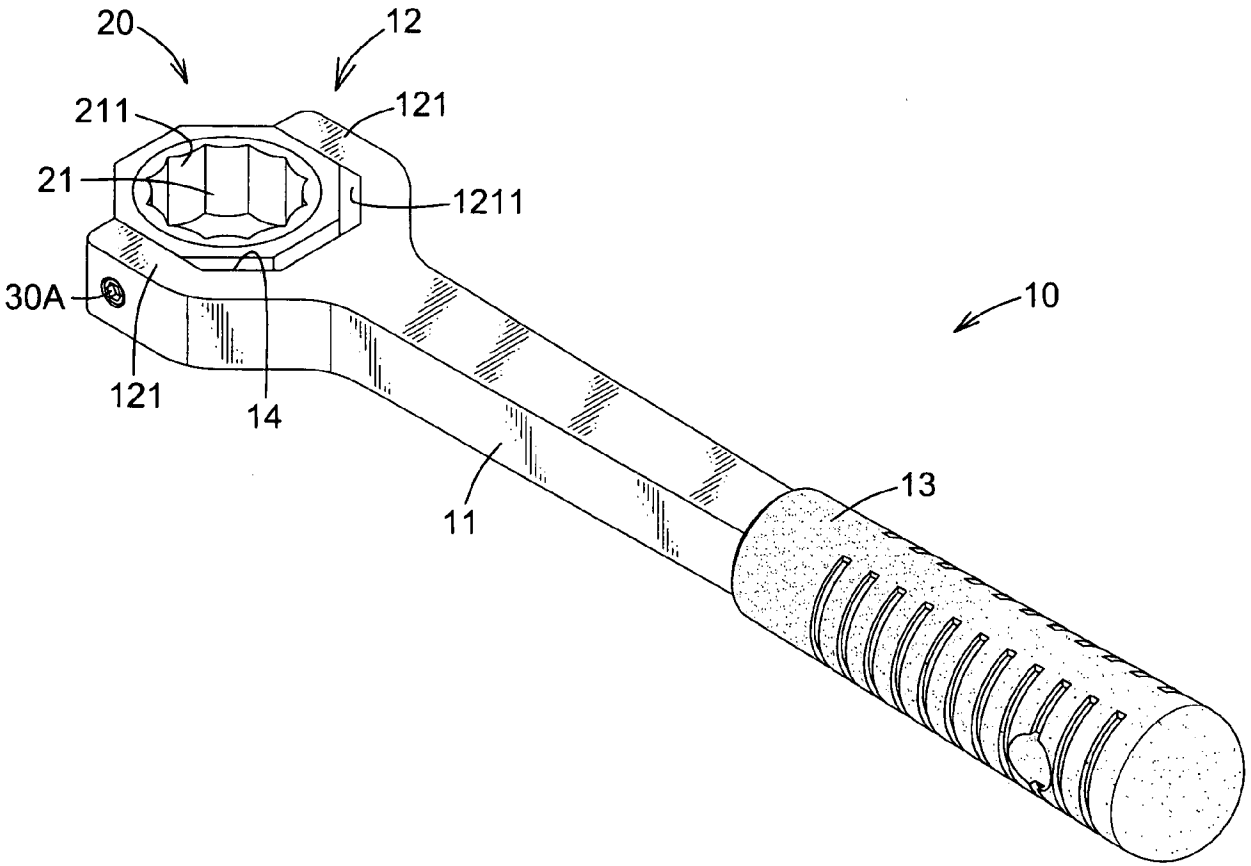
FIG. 1 is a perspective view of a first embodiment of a wrench in accordance with the present invention.
Figure 2:
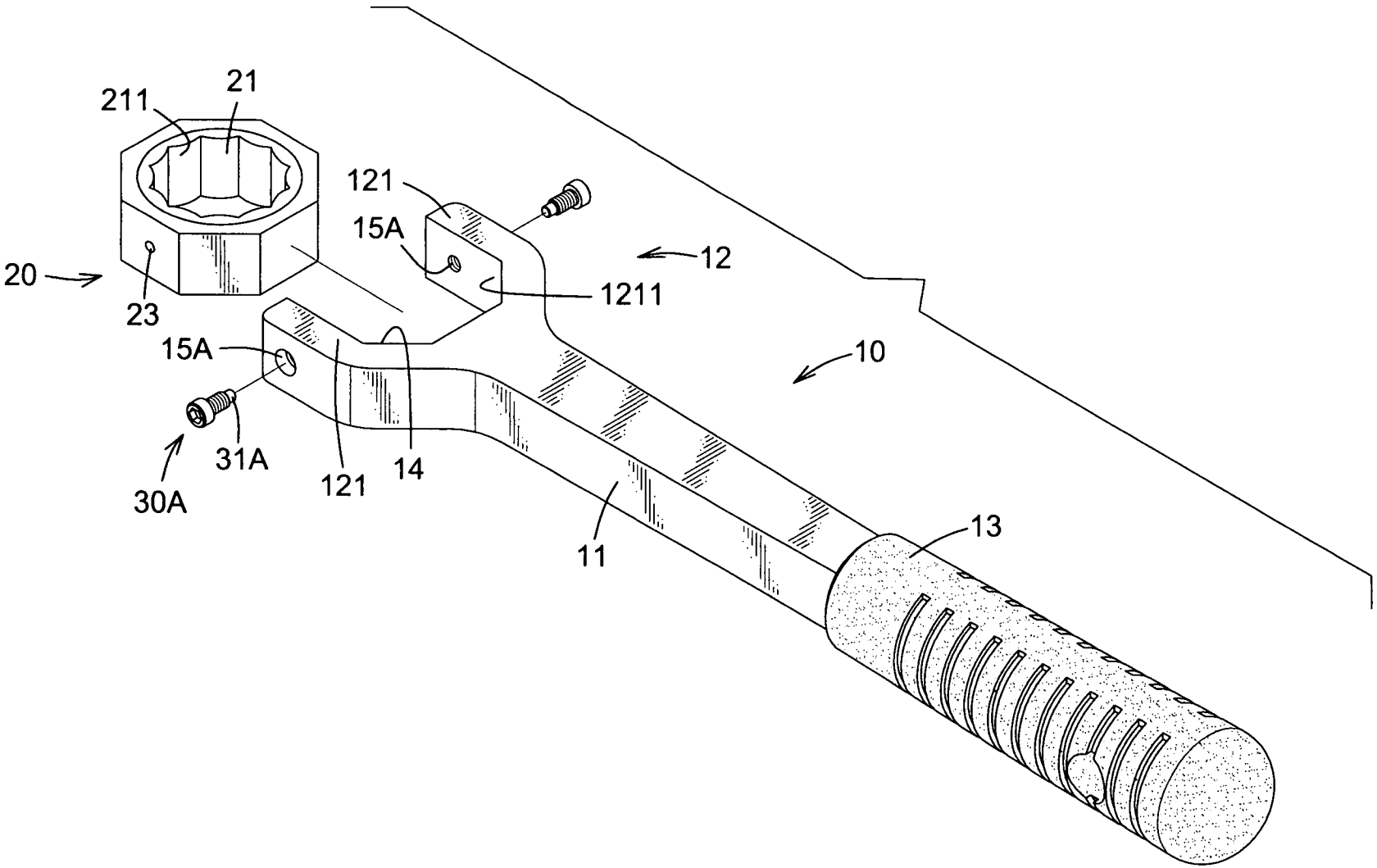
FIG. 2 is an exploded perspective view of the wrench in FIG. 1.
Figure 3:
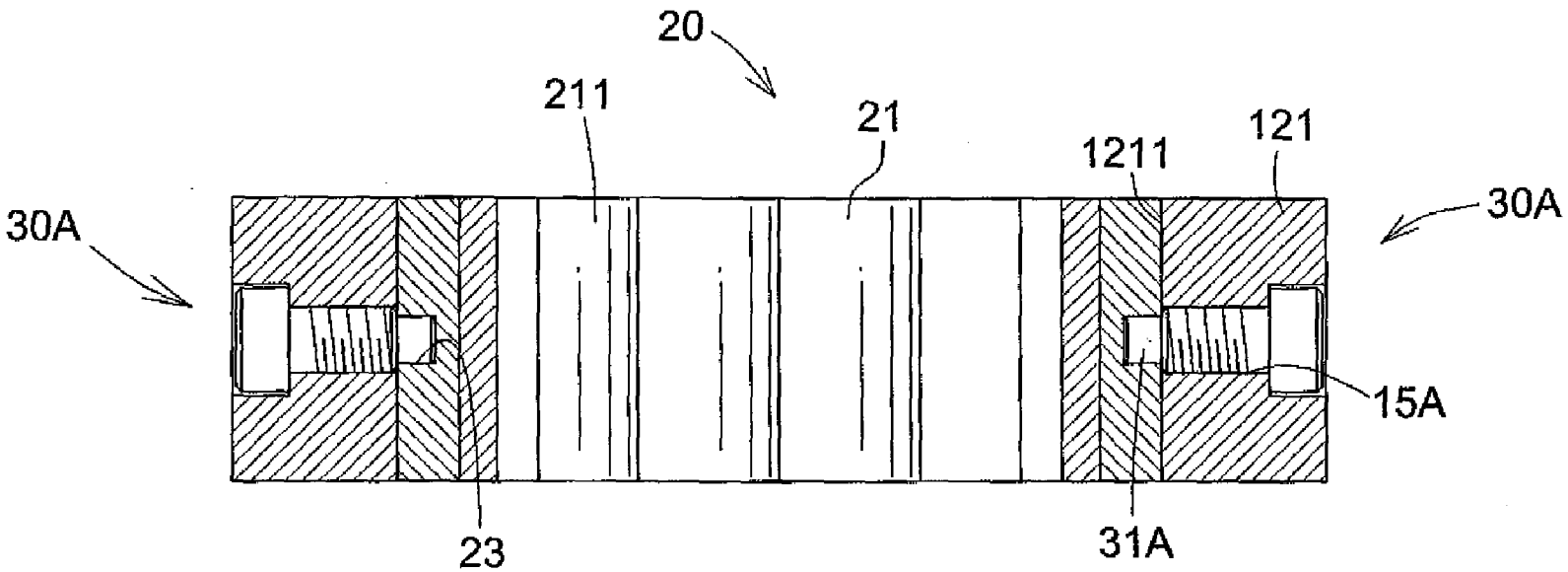
FIG. 3 is a side view in partial section of the wrench in FIG. 1.

With reference to FIGS. 1 to 3, a first embodiment of a wrench (10) in accordance with the present invention has a body (11), a head (20) and a pivotal device (30A).

The body (11) is elongated and has a thickness, a proximal end, a distal end (12), two arms (121), a handle (13) and a mounting recess (14). The arms (121) are extended on the distal end (12) of the body (11) and forms the mounting recess (14) between the arms (121). Each arm (12) has a free end, a holding surface (1211) and a hole (15A). The holding surface (1211) is formed on the arm (121) and faces to the holding surface (1211) on the other arm (12). The two holding surfaces (1211) are parallel to each other. The handle (13) is mounted on the proximal end of the body (11). The hole (15A) is defined through the arm (121) and is near the free end of the arm (121). The two holes (15A) are aligned with each other.

The head (20) has an octagonal cross section and is pivotally and replaceably mounted inside the mounting recess (14) in the body (11). The head (20) has a thickness, an outer surface, a driving hole (21), multiple arc protrusions (211) and two pivotal holes (23). The thickness of the head (20) is the same as that of the body (11). The driving hole (21) is defined through the head (20) and has an inner surface. In a preferred embodiment, the driving hole (21) may be, but not limited to, a hexagon hole for holding a nut or a threaded pin directly. The multiple arc protrusions (211) are formed on the inner surface of the driving hole (21) for holding a nut or a threaded pin securely. The two pivotal holes (23) are defined in the outer surface and are respectively corresponding to the holes (15A) in the arms (121) of the body (11).

The pivotal device (30A) is mounted between the body (11) and the head (20) for holding the head (20) in the mounting recess (14). The pivotal device (30A) may be two threaded pins, each threaded pin has a distal end and a post (31A). The post (31A) is formed on the distal end of the threaded pin. The two threaded pins are respectively mounted through the holes (15A) and into the pivotal holes (23A), so that the head (20) will be pivotally mounted inside the recess (14) in the body (11).

Figure 4:
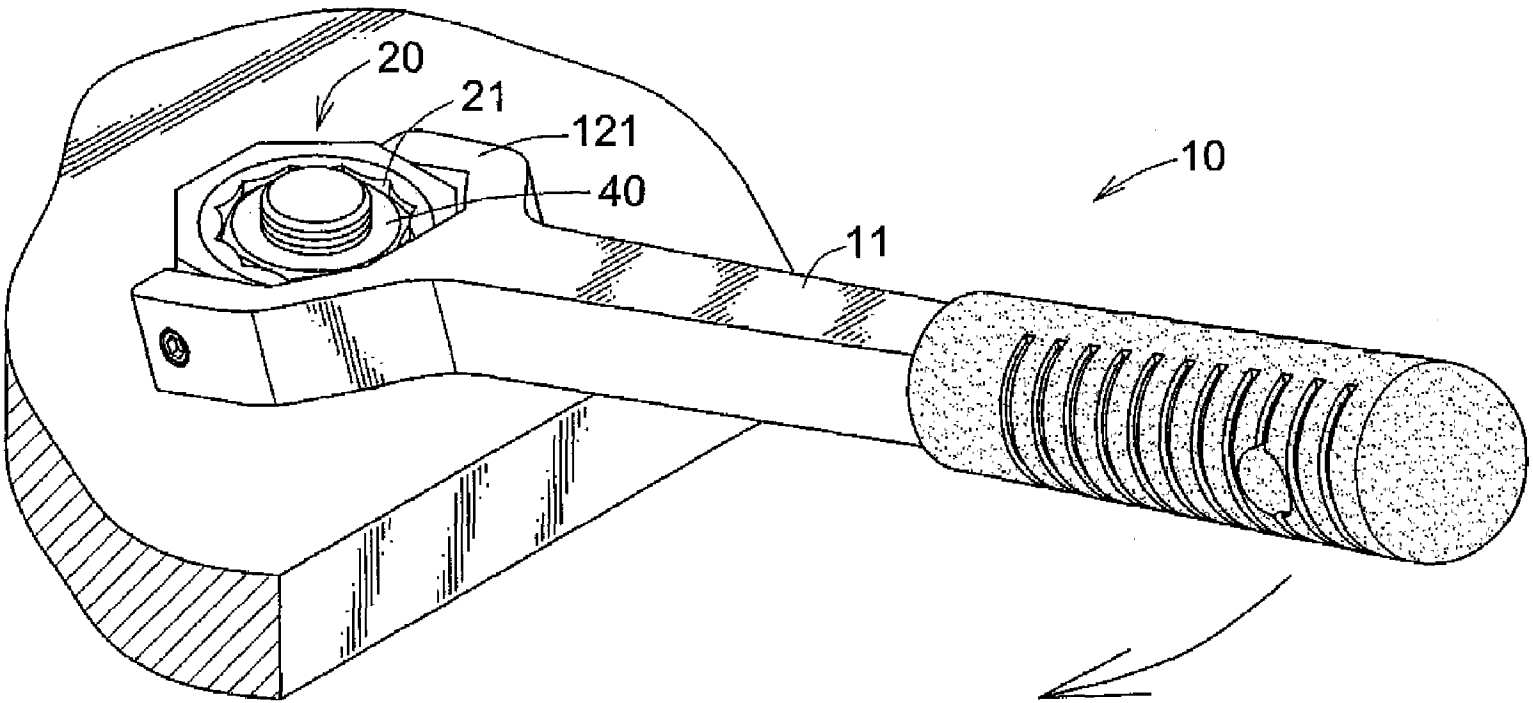
FIG. 4 is an operational perspective view of the wrench in FIG. 1.
Figure 5:
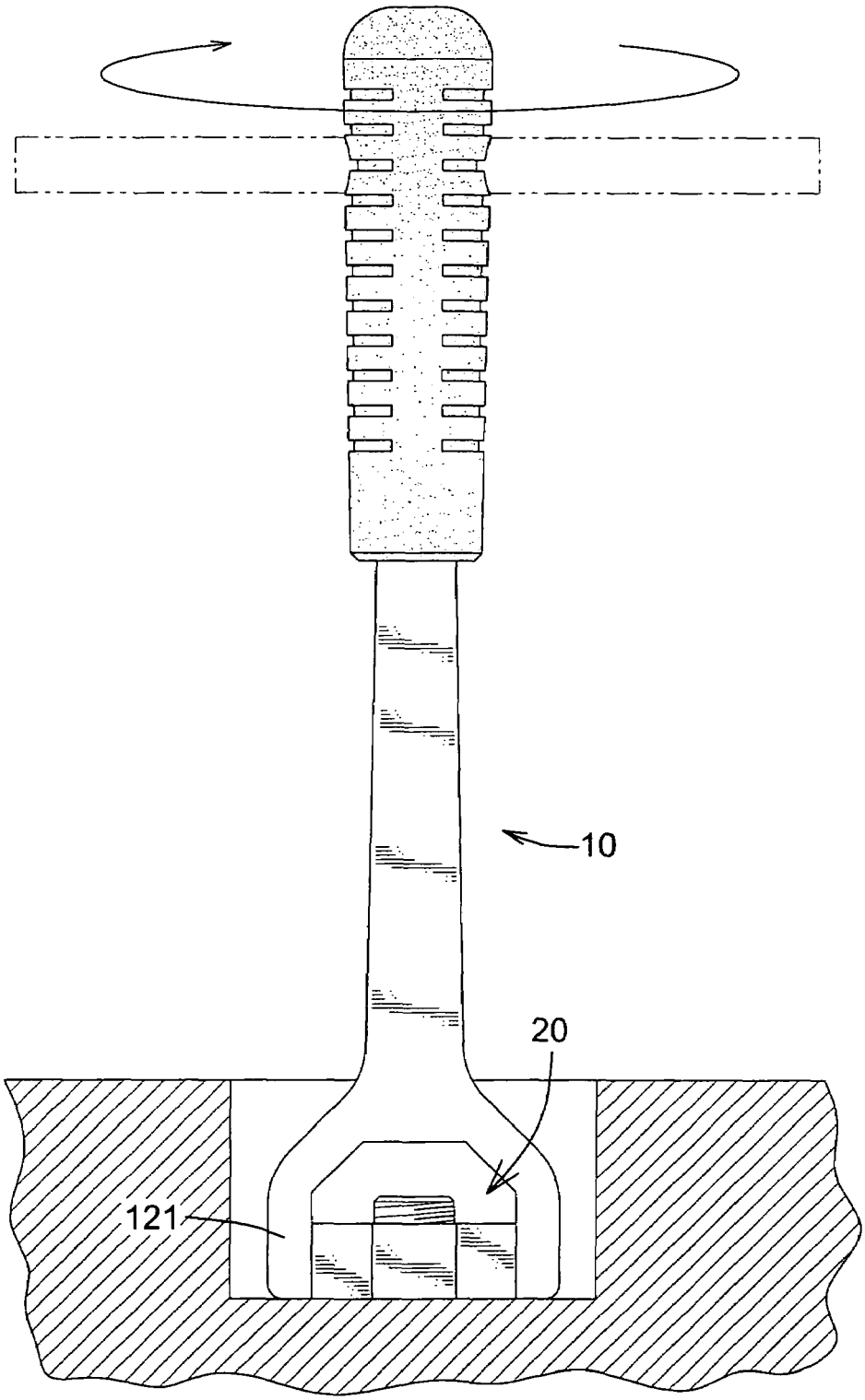
FIG. 5 is an operational side view in partial section of the wrench in FIG. 1.

With reference to FIGS. 4 and 5, when the wrench (10) in accordance with the present invention is in use, the driving hole (21) in the head (20) is mounted around a nut (40) and the body (11) is rotated to rotate the nut (40) with the head (20). Because the head (20) is pivotally mounted with the body (11), the angle between the body (11) and the head (20) may be adjusted for using in a limited space. When the wrench (10) is used in a very limited space, the body (11) may become perpendicular to the head (20), and the body (11) is still convenient for use.

When the head (20) of the present wrench (10) is replaced, the pivotal device (30A) is removed firstly with a tool. Therefore, the post (31A) of each threaded pin is escaped from the pivotal hole (23), and the head (20) can be replaced.

Figure 6:
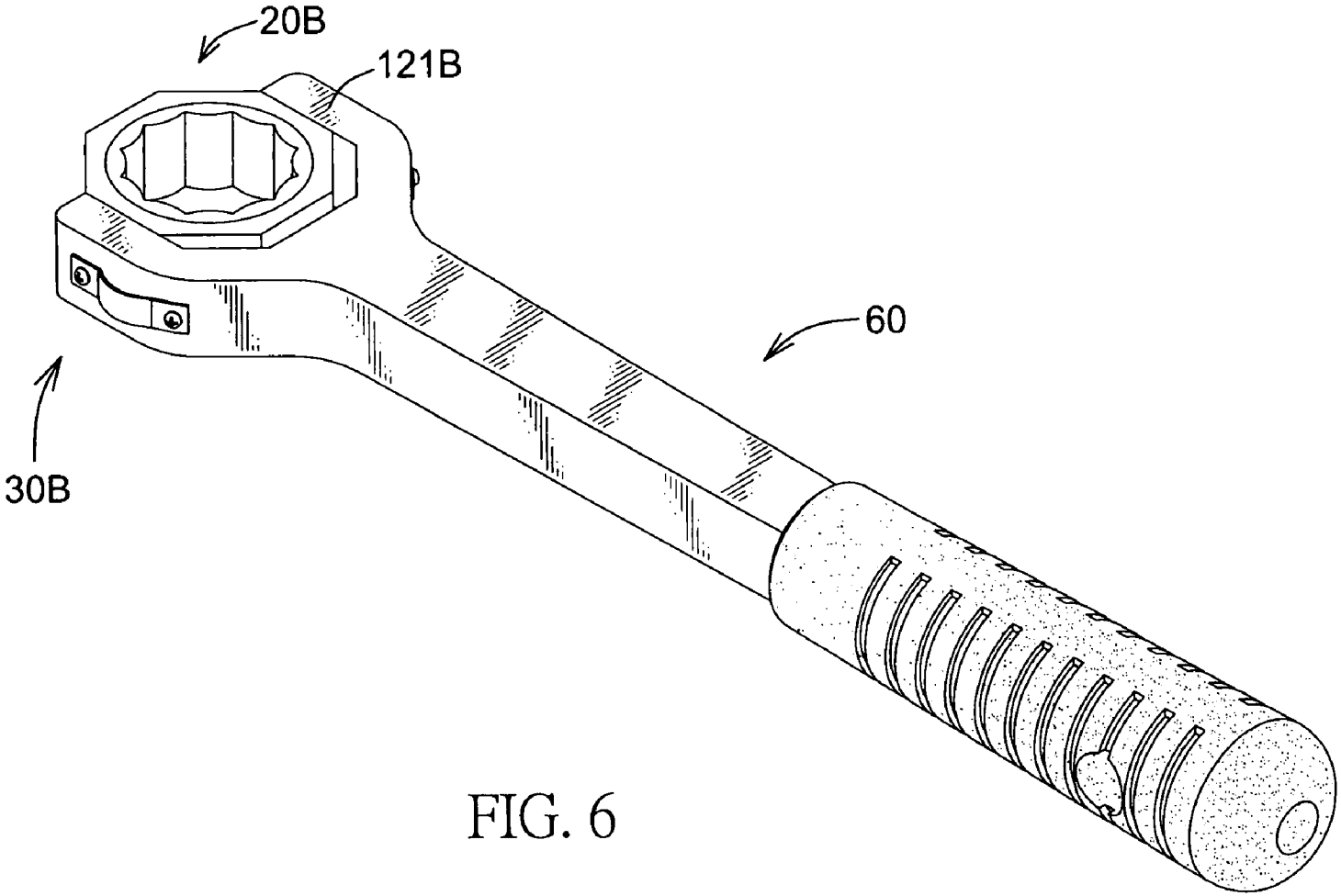
FIG. 6 is a perspective view of a second embodiment of a wrench in accordance with the present invention.
Figure 7:
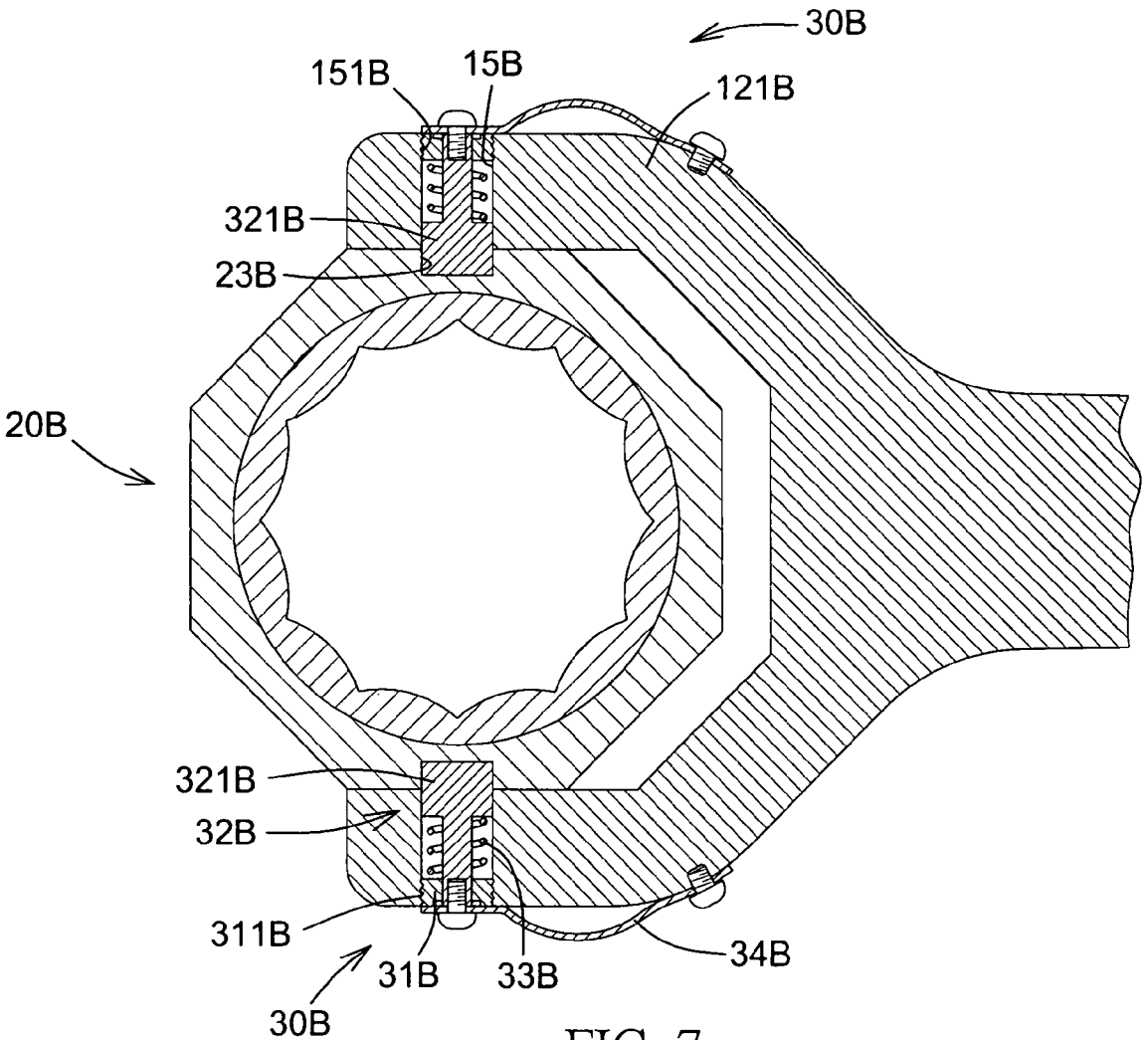
FIG. 7 is a side view in partial section of the wrench in FIG. 6.

With reference to FIGS. 6 and 7, a second embodiment of a wrench (60) in accordance with the present invention is shown. The wrench (60) has a body, a head (20B) and two pivotal devices (30B). The way to assemble the body and the head (20B) is same as foregoing described. The differences are described as follows.

Each arm (121B) has an outer surface. Each hole (15B) defined in the arm (121B) has an inner thread (15 1B) near the outer surface of the arm (121B).

The head (20B) has two pivotal holes (23B) defined in the outer surface of the head (20) and corresponding respectively to the holes (15B) in the arms (121B).

The two pivotal devices (30B) are respectively mounted between the arms (121B) and the head (20B) for pivotally holding the head (20B) between the arms (121B). Each pivotal device (30B) has a holder (31B), a pivotal rod (32B), a spring (33B) and a resilient tab (34B). The holder (31B) has an outer threaded portion (311B) and is mounted inside the holes (15B) and screwed with the inner thread (151B) in the corresponding hole (15B). The pivotal rod (32B) is mounted inside the corresponding hole (15B) and held by the holder (31B). The pivotal rod (32B) has an enlarged end (321B). The enlarged end (321B) extends into a corresponding pivotal hole (23B) in the head (20B). The spring (33B) is mounted around the pivotal rod (32B) and abuts the enlarged end (321B) and the holder (31B). The resilient tab (34B) is mounted on a corresponding arm (121B) and has a distal end and a proximal end. The proximal end of the resilient tab (34B) is mounted on the corresponding arm (121B), and the distal end of the resilient tab (34B) is mounted with the pivotal rod (32B).

Figure 8:
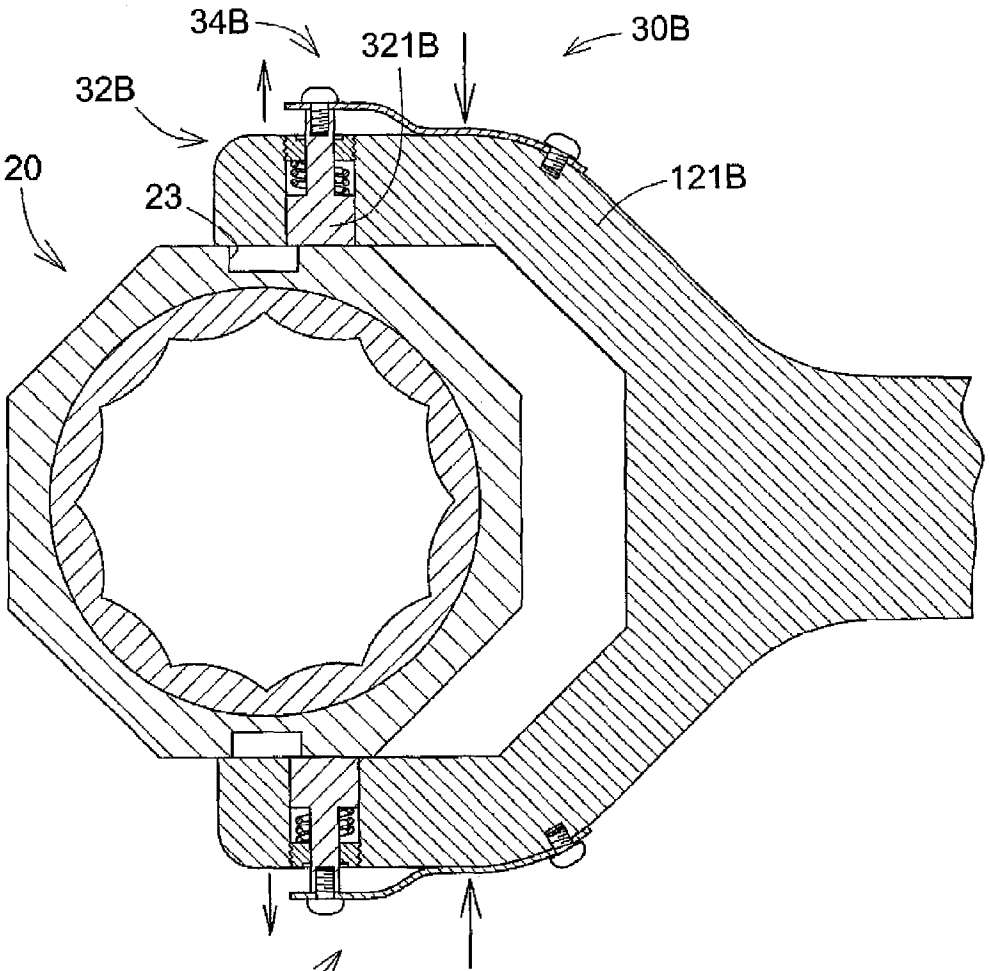
FIG. 8 is an operational side view in partial section of the wrench in FIG. 6 when the head of the wrench is changed.

With reference to FIG. 8, when the head (20B) is replaced, the resilient tabs (34B) are pressed to pull the enlarged ends (321B) of the pivotal rods (32B) moving inside the holes (15B) and escaping from the pivotal holes (23B). Therefore, the head (20B) will not be held by the pivotal devices (30B) and will be replaced without a hand tool.

Figure 9:
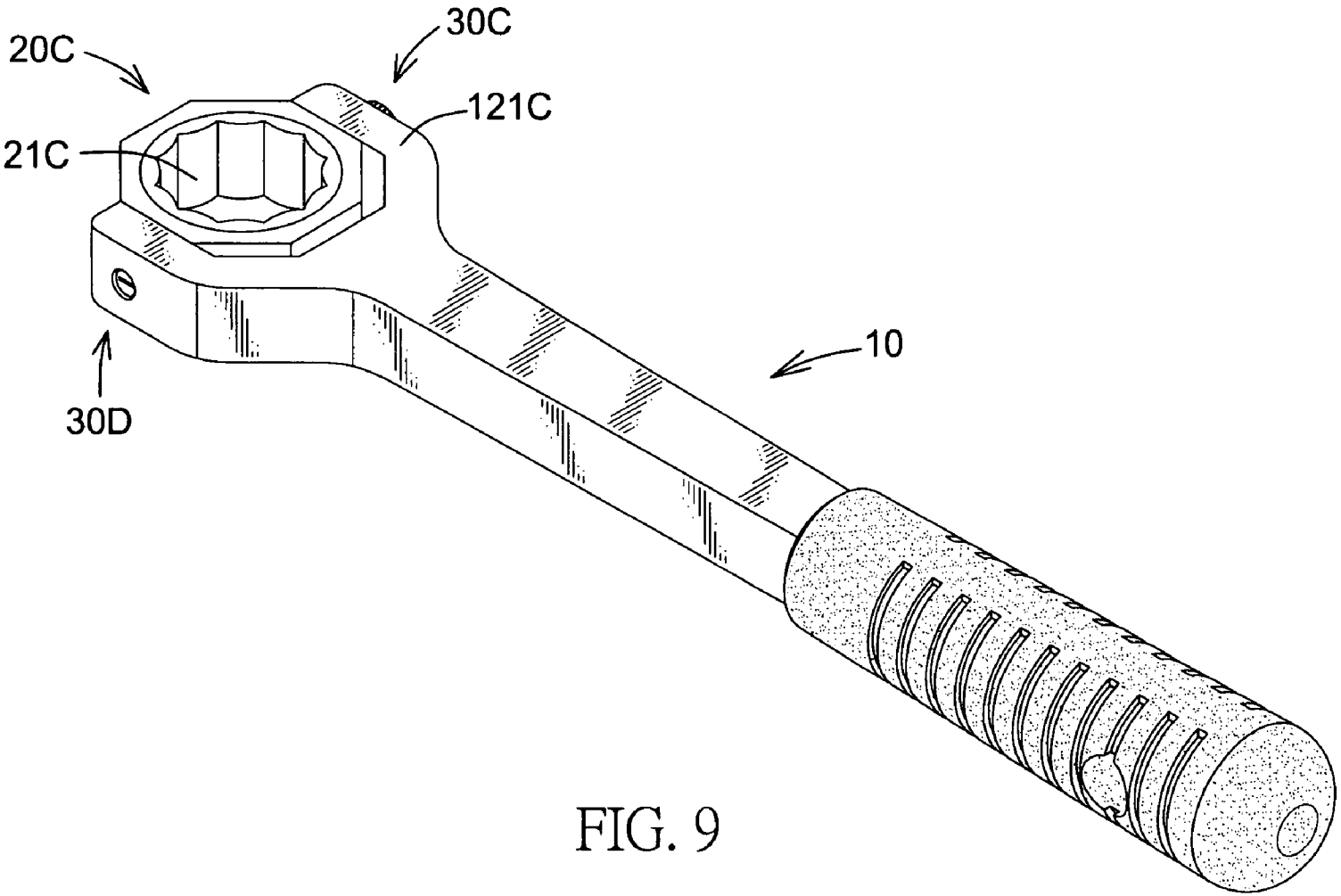
FIG. 9 is a perspective view of a third embodiment of a wrench in accordance with the present invention.
Figure 10:
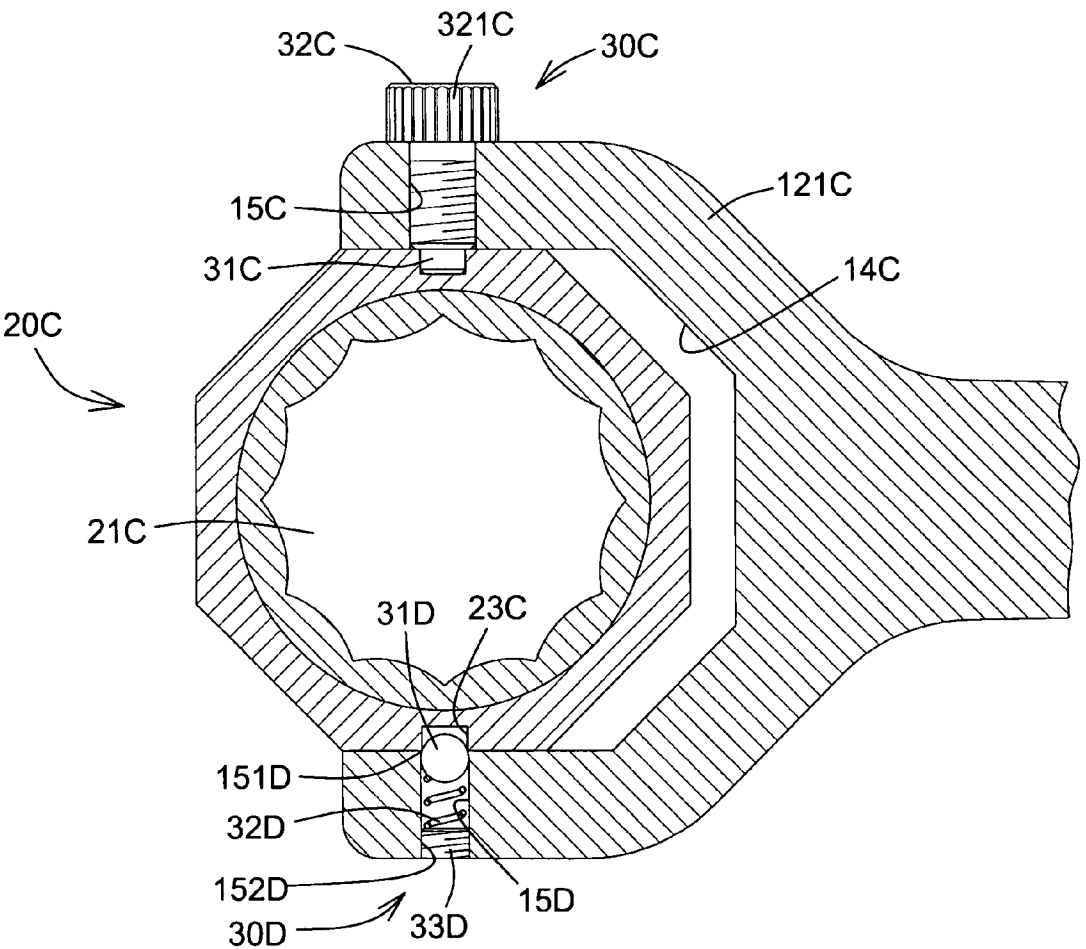
FIG. 10 is a side view in partial section of the wrench in FIG. 9.

With reference to FIGS. 9 and 10, a third embodiment of a wrench in accordance with the present invention is shown. The wrench of the third embodiment is almost the same as the first embodiment, but differs in the followings.

The arms (121C) have a first hole (15C) and a second hole (15D) respectively defined through the arms (121C) and near the distal end of the arms (121C). The first hole (15C) is a threaded hole, and the second hole (15D) is a through hole and has an inner surface, a diameter (151D) and a threaded portion (152D). The threaded portion (152D) is defined near the outer surface of the arm (121C).

The pivotal devices are mounted between the head and the body and have a first pivotal device (30C) and a second pivotal device (30D). The first pivotal device (30C) is a threaded pin and is mounted inside the first hole (15C). The first pivotal device (30C) has an inner end, an outer end, a post (31C) and an enlarged head (32C). The post (31C) is formed on the inner end. The enlarged head (32C) is formed on the outer end of the threaded pin and has a pattern (321C) formed on the enlarged head (32C) for preventing slipping. The post (31C) extends into the recess (14C) between the two arms (121C) and is mounted inside the pivotal hole (23C) in the head (20C) having the driving hole (21C). The second pivotal device (30D) is mounted inside the second hole (15D) and has a ball (31D), a spring (32D) and a threaded post (33D). The ball (31D) is received inside the second hole (15D) and partially extends out of the second hole and into a corresponding pivotal hole. The spring (32D) is mounted inside the second hole (15D). The threaded post (33D) is threaded with the threaded portion (152D) in the second hole (15D) and abuts against the spring (32D).

Figure 11:
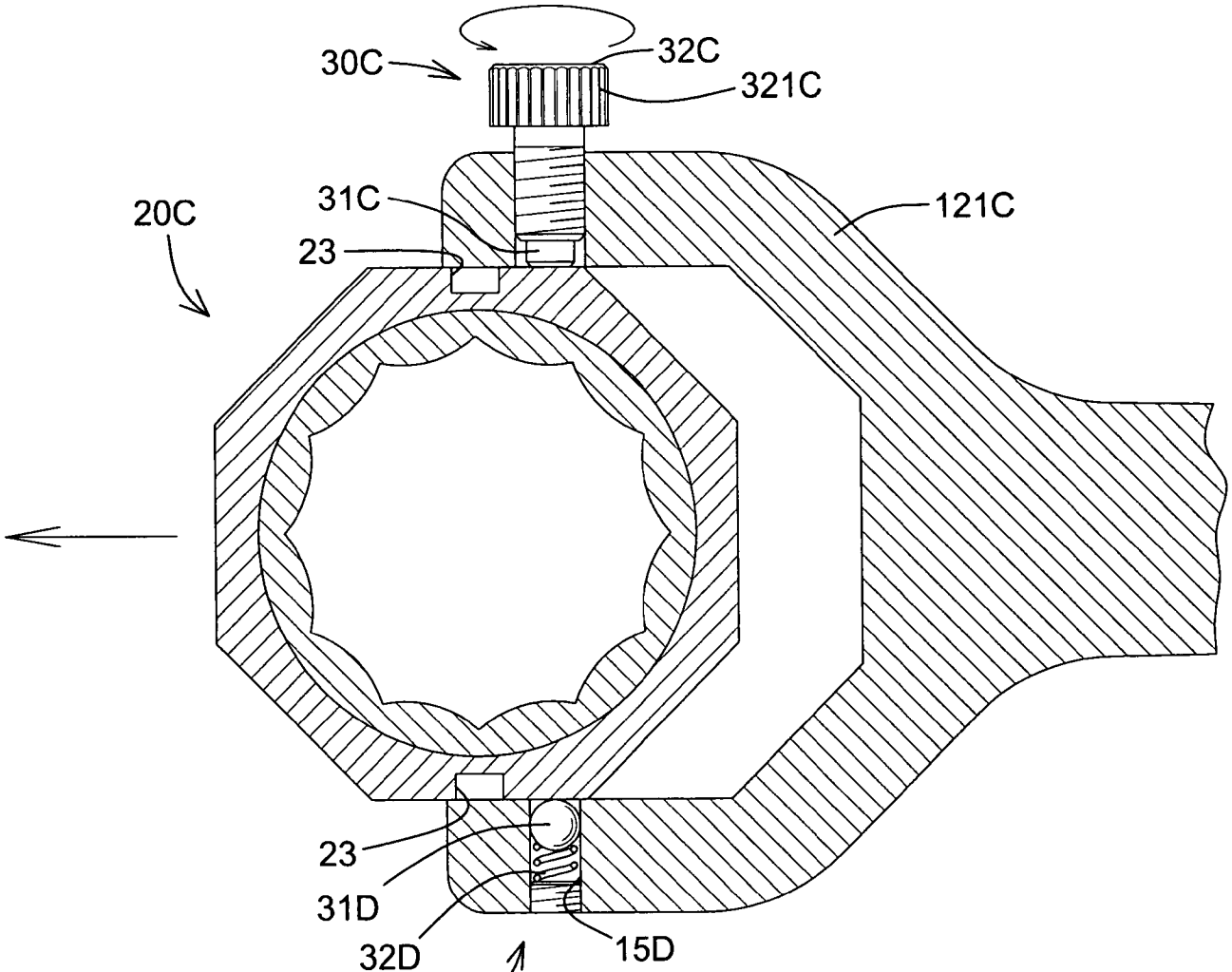
FIG. 11 is an operational side view in partial section of the wrench in FIG. 9 when the head of the wrench is changed.

With reference to FIG. 11, when the head (20C) is replaced, the first pivotal device (30C) is loosened from holding the head (20C). When the head (20C) is removed, the ball (31D) is pressed into the second hole (15D), and the head (20C) may be replaced.

Figure 12:
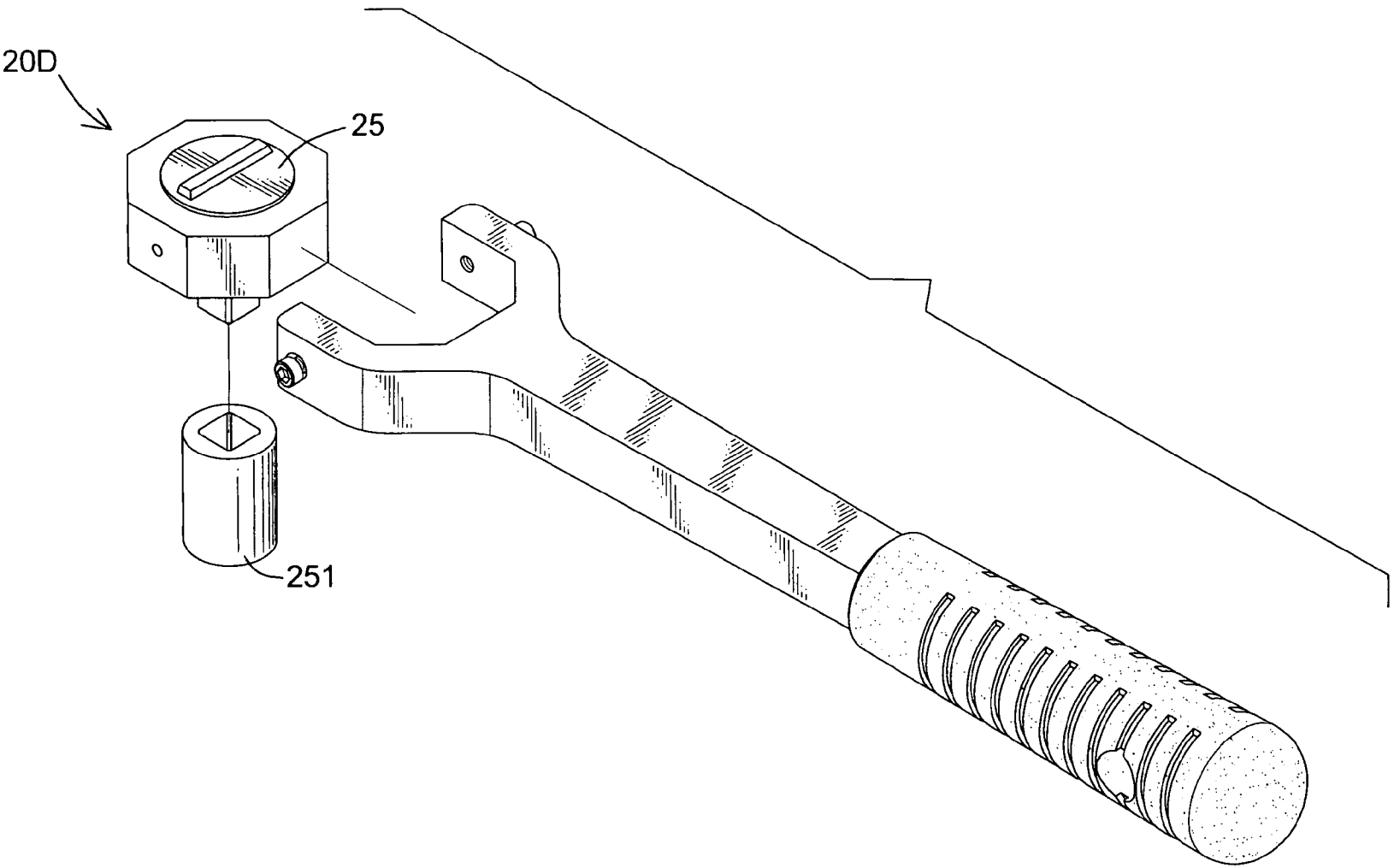
FIG. 12 is an exploded perspective view of a fourth embodiment of a wrench in accordance with the present invention.
Figure 13:
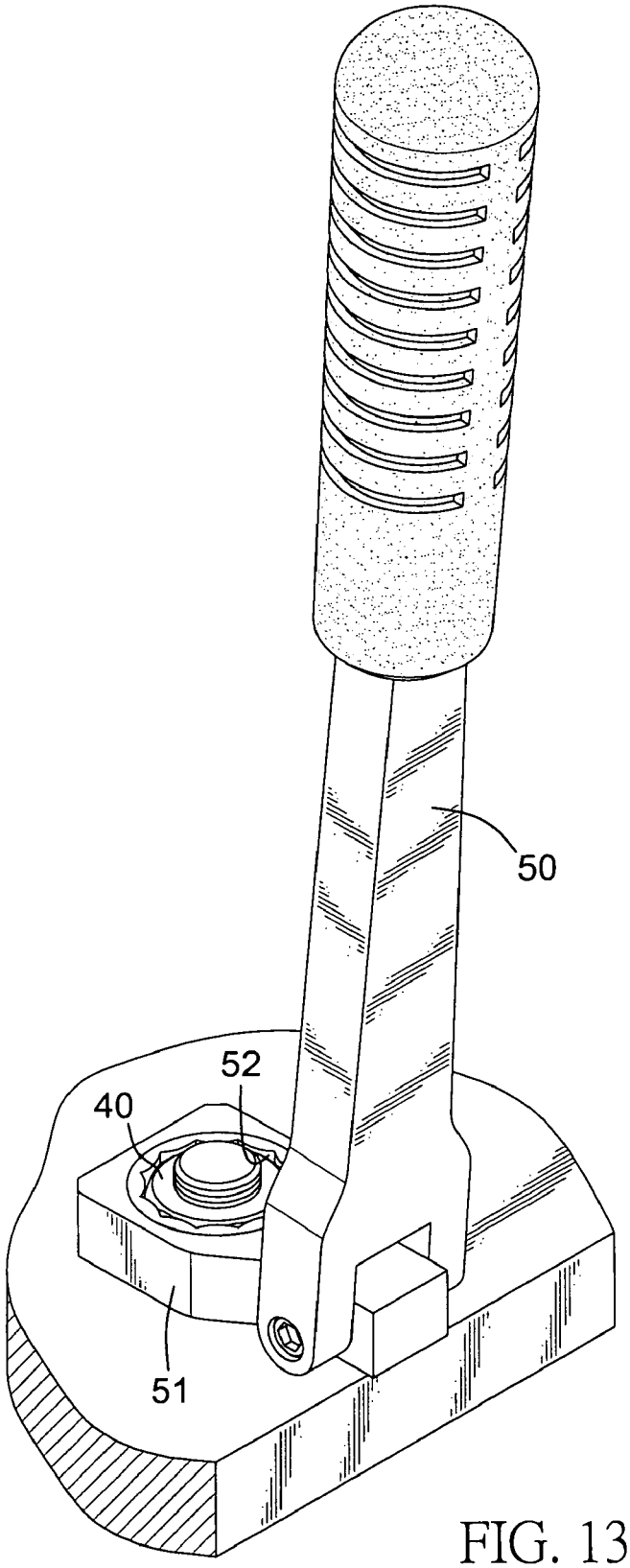
FIG. 13 PRIOR ART
FIG. 13 is perspective view of a first conventional wrench in accordance with the prior art.
Figure 14:
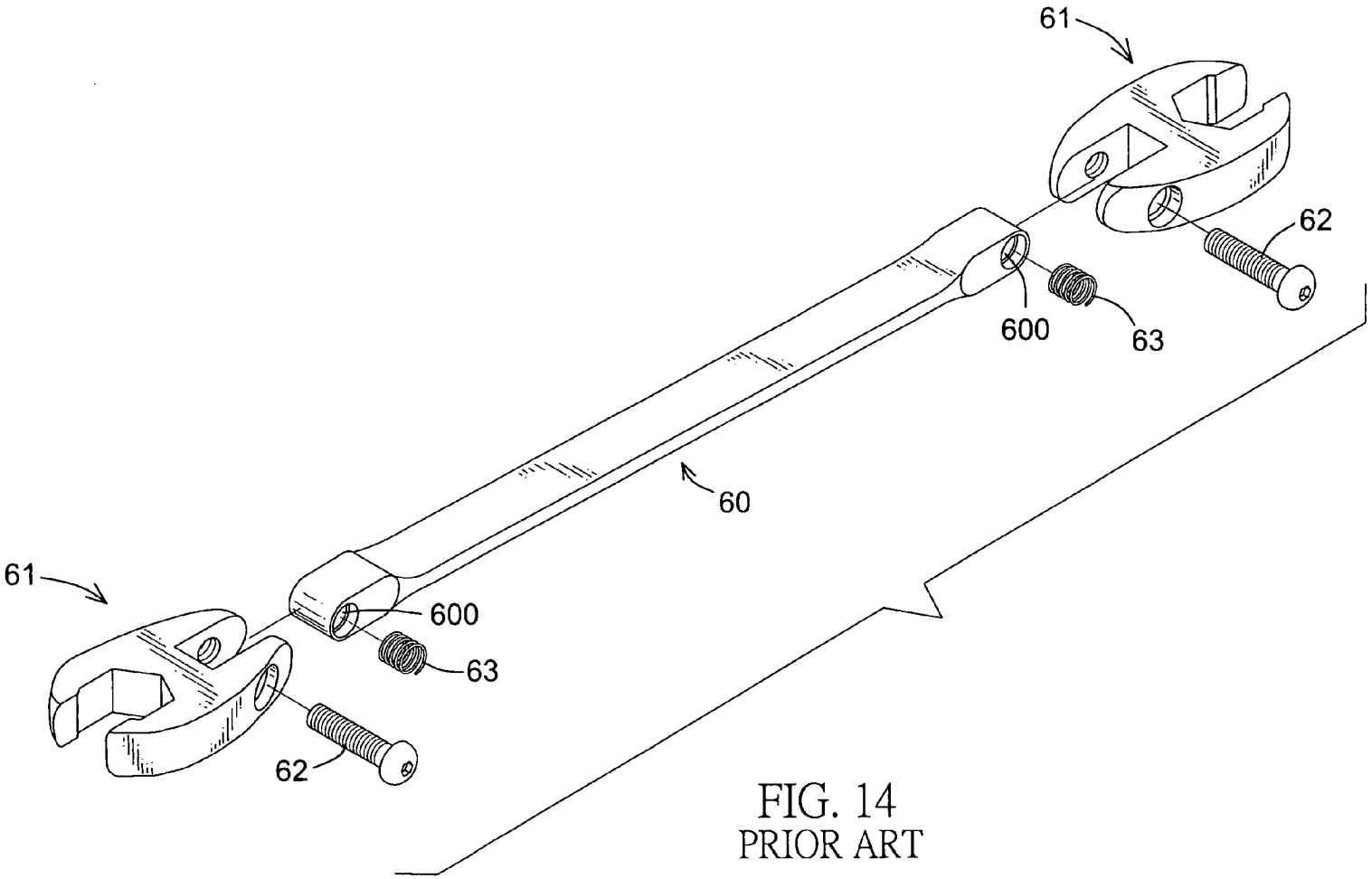
FIG. 14 PRIOR ART
FIG. 14 is an exploded perspective view of a second conventional wrench in accordance with the prior art.
Figure 15:
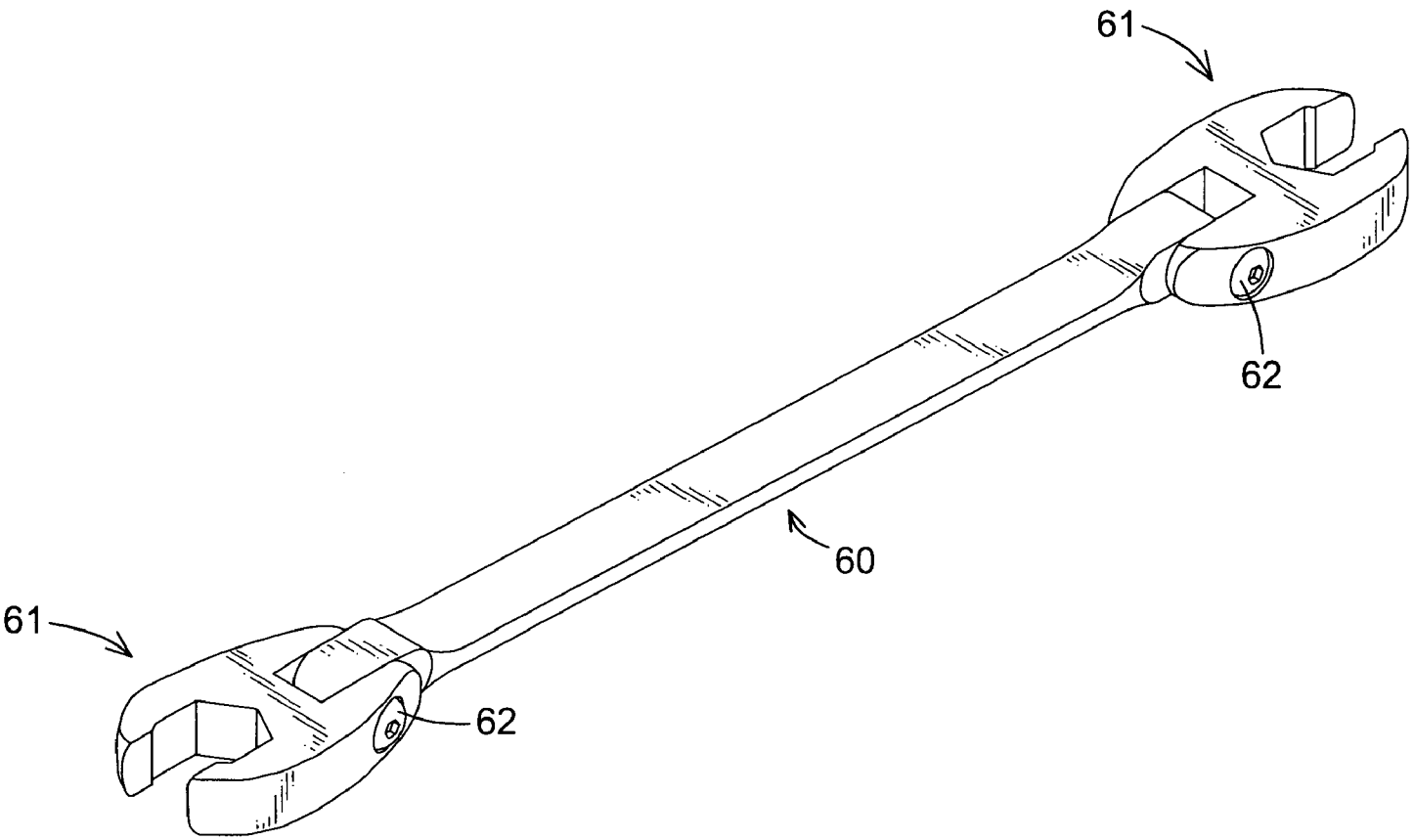
FIG. 15 PRIOR ART
FIG. 15 is a perspective view of the conventional wrench in FIG. 14.

With reference to FIG. 12, a fourth embodiment of a wrench in accordance with the present invention is shown. The way to assemble the body and the head may be the same as the first, the second or the third embodiment, but differs in the type of the head. The head (20D) may further comprise a ratchet (25) mounted on the head (20D). The ratchet (25) is used for driving a sleeve (251).

The wrench in accordance with the present invention has the following advantages:

1. When the wrench is used in a limited space, the body may be rotated to various angles to the head and is still convenient for operating the wrench. Therefore, the wrench could be applied in various spaces.

2. To replace the head is convenient. Because the head is pivotally mounted on the body, by the pivotal device of the wrench, it is convenient for a user to replace the head of the wrench. Therefore, a user may replace the head conveniently depending on his/her needs.

It is to be understood, however, that even though numerous characteristics and advantages of the present invention have been set forth in the foregoing description, together with details of the structure and function of the invention, the disclosure is illustrative only, and changes may be made in detail, especially in matters of raw material used, shape, size, installing surface and arrangement of parts within the principles of the invention to the full extent indicated by the broad general meaning of the terms in which the appended claims are expressed.

What is claimed is:

1. A wrench comprising:

a body having a thickness, a proximal end, a distal end, two arms separately formed on the distal end and forming a mounting recess between the two arms, each arm having an outer surface, a free end, and a hole defined through the arm near the free end, wherein the two holes in the two arms face each other, wherein the hole defined in each arm of the body further comprises an inner thread formed near the outer surface of the corresponding arm, and a handle mounted on the proximal end of the body;

a head pivotally mounted inside the mounting recess in the body and having a thickness, an outer surface, a driving hole defined through the head, and two pivotal holes defined in the outer surface and respectively corresponding to the holes in the arm of the body; and two pivotal devices respectively mounted between the arms and the head to hold the head in the mounting recess, and each pivotal device having a holder mounted inside a corresponding one of the holes and having an outer threaded portion screwed with the inner thread in the corresponding hole, a pivotal rod mounted inside the corresponding hole, being held by the holder and having an enlarged end received inside a corresponding pivotal hole in the head, a spring mounted around the pivotal rod and abutting the enlarged end and the holder, and a resilient tab mounted on a corresponding arm and having a proximal end mounted on the corresponding arm, and a distal end mounted with the holder.

2. The wrench as claimed in claim 1, wherein the head further comprises multiple arc protrusions form on the inner surface of the driving hole.

3. The wrench as claimed in claim 2, wherein the thickness of the head is equal to the thickness of the body.

4. The wrench as claimed in claim 3, wherein the head further comprises a ratchet mounted inside the driving hole in the head.

5. The wrench as claimed in claim 1, wherein the thickness of the head is equal to the thickness of the body.

6. The wrench as claimed in claim 5, wherein the head further comprises a ratchet mounted inside the driving hole in the head.

7. The wrench as claimed in claim 1, wherein the head further comprises a ratchet mounted inside the driving hole in the head.

8. A wrench comprising:

a body having a thickness, a proximal end, a distal end, two arms separately formed on the distal end and forming a mounting recess between the two arms, each arm having an outer surface, a free end, and a hole defined through the arm near the free end, wherein the two holes in the two arms face each other, wherein the arms have a first hole defined through one of the arms and being a threaded hole, and a second hole defined through the other arm, being a through hole and having an inner surface, a diameter and a threaded portion defined near the outer surface of the arm, and a handle mounted in the proximal end of the body, a head pivotally mounted inside the mounting recess in the body and having a thickness, an outer surface, a driving hole defined through the head, and two pivotal holes defined in the outer surface and respectively corresponding to the holes in the arm of the body, and two pivotal devices mounted between the head and the body to hold the head in the mounting recess, with the two pivotal devices having a first pivotal device mounted inside the first hole and having an inner end, an outer end, a post formed on the inner end and mounted inside a corresponding pivotal hole in the head, and an enlarged head formed on the outer end of the threaded pin, and a second pivotal device mounted inside the second hole and having a ball received inside the second hole and partially extending out of the second hole and into a corresponding pivotal hole, a spring mounted inside the second hole, and a threaded post screwed with the threaded portion in the second hole and abutting against the spring.

9. The wrench as claimed in claim 8, wherein the head further comprises a ratchet mounted inside the driving hole in the head.

10. The wrench as claimed in claim 9, wherein the head further comprises multiple arc protrusions form on the inner surface of the driving hole.

11. The wrench as claimed in claim 10, wherein the thickness of the head is equal to the thickness of the body.

12. The wrench as claimed in claim 8, wherein the head further comprises multiple arc protrusions form on the inner surface of the driving hole.

13. The wrench as claimed in claim 12, wherein the thickness of the head is equal to the thickness of the body.

14. The wrench as claimed in claim 8, wherein the thickness of the head is equal to the thickness of the body.

* * * * *